US008623798B2

(12) United States Patent
Cherpeck et al.

(10) Patent No.: US 8,623,798 B2
(45) Date of Patent: Jan. 7, 2014

(54) LUBRICATING OIL COMPOSITIONS CONTAINING A TETRAALKYL-NAPTHALENE-1,8 DIAMINE ANTIOXIDANT

(75) Inventors: Richard E. Cherpeck, Cotati, CA (US); Carrie Y. Chan, Daly City, CA (US); Gaurav Bhalla, Hercules, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 814 days.

(21) Appl. No.: 12/336,128

(22) Filed: Dec. 16, 2008

(65) Prior Publication Data

US 2010/0152079 A1 Jun. 17, 2010

Related U.S. Application Data

(60) Provisional application No. 61/015,586, filed on Dec. 20, 2007.

(51) Int. Cl.
*C10M 133/12* (2006.01)

(52) U.S. Cl.
USPC ..... 508/556; 508/362; 508/563

(58) Field of Classification Search
USPC ..... 508/362, 556, 563
See application file for complete search history.

(56) References Cited

U.S. PATENT DOCUMENTS

| | | | | |
|---|---|---|---|---|
| 2,718,501 | A | 9/1955 | Harte | |
| 2,943,112 | A | 6/1960 | Popoff et al. | |
| 2,958,663 | A | 11/1960 | Westcott et al. | |
| 3,345,292 | A | 10/1967 | Neale et al. | |
| 3,452,056 | A | 6/1969 | Sundholm | |
| 3,533,992 | A | 10/1970 | Sundholm | |
| 3,535,243 | A | 10/1970 | Chao et al. | |
| 3,655,559 | A | 4/1972 | Holt | |
| 3,660,290 | A | 5/1972 | Schlobohm | |
| 4,032,462 | A | 6/1977 | Hotten et al. | |
| 4,089,792 | A | 5/1978 | Lowe | |
| 4,102,796 | A | 7/1978 | Lowe | |
| 4,795,774 | A | 1/1989 | Kluttz | |
| 5,198,134 | A * | 3/1993 | Steinberg et al. | 508/556 |
| 5,244,953 | A | 9/1993 | Odorisio et al. | |
| 6,306,802 | B1 | 10/2001 | Shaub | |
| 2006/0234879 | A1 * | 10/2006 | Harrison et al. | 508/508 |
| 2007/0142243 | A1 | 6/2007 | Cherpeck et al. | |

FOREIGN PATENT DOCUMENTS

| | | | |
|---|---|---|---|
| EP | 0 411 750 | A | 2/1991 |
| EP | 411750 | A2 * | 2/1991 |
| EP | 0 512 954 | A | 11/1992 |
| GB | 737124 | A | 9/1955 |

OTHER PUBLICATIONS

Alder, R. W., "Strain Effects on Amine Basicities", Chem. Rev., 1989, 89, 1215-1223, American Chemical Society.

KATHON™ 893 MW Biocide Metalworking Fluid Fungicide for Water-Based Cutting Fluids, ROHM and HAAS, BIO.KATHON 893 MW Biocide.PDS.E. Apr. 2008, http://www.dow.com/ucon/stle2011/pdfs/microbial_lit/kathon_893_mw.pdf, May 24, 2011.

KATHON™ 886 MW Microbicide Metalworking Fluid Fungicide Microbicide for Water-Based Cutting Fluids, ROHM and HAAS, Sep. 2006, http://www.dow.com/ucon/stle2011/pdfs/microbial_lit/kathon_886_mw.pdf, May 24, 2011.

Ozeryanskii, V.A., Pozharskii, A.F., Koroleva, M.G., Shevchuk, D.A., Kazheva, O.N., Chekhlov, A.N., Shilov, G.V. and Dyachenko, O.A., "N,N,N'-Trialkyl-1,8-diaminoaphthalenes: convenient method of preparation from protonated proton sponges and the first X-ray information", www.sciencedirect.com, Tetrahedron 61 (2005) 4221-4232, Elsevier Ltd.

Pozharskii, A. F., "Naphthalene 'proton sponges'", Russian Chemical Reviews 67 (1) 1-24 (1998), Russian Academy of Sciences and Turpion Ltd., http://iopscience.iop.org/0036-021X/67/1/R01, Aug. 12, 2010.

Rossmoore, L.A. and Rossmoore, H. W., "Metalworking Fluid Microbiology", Byers, J.P. (Ed.), *Metalworking Fluids*,New York: Marcel Dekker, Inc. 1994, pp. 247-271.

Ghosh, T., "Reaction of Isothiazolones with Amines", Phosphorus, Sulfur and Silicon, 1999, vol. 153-154, pp. 367-368, Overseas Publishers Association N.V.

Krzeminski, S.F., Brackett, C.K., and Fisher, J.D., "Fate of Microbicidal 3-Isothiazolone Compounds in the Environment: Modes and Rates of Dissipation", J. Agric. Food Chem., vol. 23, No. 6, pp. 1060-1068, 1975.

Schwingel, W.R., "Biocides as Lubricant Additives", Rudnick, LR. (Ed.) *Lubricant Additives: Chemistry and Applications,* New York: Marcel Dekker, Inc., 2003, pp. 371-381.

United States Environmental Protection Agency, Prevention, Pesticides and Toxic Subtances (7508C), Reregistration Eligibility Decision (RED) Methylisothiazolinone, EPA738-R-98-012, Oct. 1998.

Williams, T.M. and McGinley, H.R., "Deactivation of Industrial Water Treatment Biocides", Paper No. 10049, pp. 1-15, Corrosion 2010 Conference & Expo, NACE International.

* cited by examiner

*Primary Examiner* — Jim Goloboy
(74) *Attorney, Agent, or Firm* — Joseph P. Foley

(57) ABSTRACT

Disclosed is a lubricating oil composition containing an oil of lubricating viscosity and a N,N,N',N'-tetraalkyl-naphthalene-1,8-diamine and at least one additive selected from antioxidants, dispersants, and detergents which together provide superior oxidation inhibition and are suitable lubricants for automotive and truck crankcase lubricants; as well as transmission lubricants, gear lubricants, hydraulic fluids, compressor oils, diesel and marine lubricants.

15 Claims, No Drawings

LUBRICATING OIL COMPOSITIONS CONTAINING A TETRAALKYL-NAPTHALENE-1,8 DIAMINE ANTIOXIDANT

CROSS REFERENCE TO RELATED APPLICATION:

This application claims the benefit of U.S. Provisional Application No. 61/015,586 filed Dec. 20, 2007.

FIELD OF THE INVENTION

The present invention is directed in part to a lubricating oil composition containing an oil of lubricating viscosity, a N,N,N',N'-tetraalkyl-naphthalene-1,8-diamine and a lubricating oil additive. Particularly effective is a combination of a N,N,N',N'-tetraalkyl-naphthalene-1,8-diamine and a second antioxidant such as diarylamine which together provide superior oxidation inhibition.

BACKGROUND OF THE INVENTION

Diarylamine antioxidants are known and have been widely used to improve the thermal-oxidative stability and/or light induced degradation in numerous products used in engineering; for example, they can improve the performance properties in lubricants, hydraulic fluids, metal working fluids, fuels or polymers, just to name a few.

Commonly, these diarylamines have been alkylated, see for example, U.S. Pat. No. 2,943,112 which discloses an improved process for alkylating diphenylamine and U.S. Pat. No. 3,655,559 which discloses alkylated diphenylamines as stabilizers. Alkaryl substituted diphenylamines and phenylnapthylamines (such as α-methylstyryl-diphenylamine) are disclosed for example in U.S. Pat. Nos. 3,533,992; 3,452,056 and 3,660,290.

Synergist and antagonist combinations of antioxidants have been disclosed. Effective synergistic mixtures of antioxidants are typically compounds that intercept oxidation by two different mechanisms. For example, those in which one compounds functions as decomposer of peroxides and the other compound functions as an inhibitor of free radicals. Well known heterosynergism has been disclosed between sulfur and phosphorous containing compounds (such as sulfides, dithiocarbamates, phosphites and dithiophosphates) and aminic or phenolic antioxidants. U.S. Pat. No. 2,718,501 discloses a synergistic mixture of a sulfur-containing compound, such as a wax sulfide or dioctadecyl disulfide, and an aromatic amine compound having at least 2 aromatic rings, such as phenyl alpha-naphthyl amine, for use in preventing oxidation in lubricating oils. For example, U.S. Pat. No. 2,958,663 discloses an extreme pressure lubricant composition containing from 0.01 to 5 percent each of sulfurized oleic acid, $C_{18}$-$C_{22}$ alkenyl succinic acid, chlorinated paraffin wax containing from 20 to 60 percent chlorine, diphenylamine and N,N-salicylal-1,2-propylenediamine. U.S. Pat. No. 3,345,292 discloses stabilized alkyl substituted diaryl sulfides for use as functional fluids where the stabilizer can be diaryl amine or alkylated phenol. U.S. Pat. No. 4,032,462 discloses lubricants having improved antioxidancy having an oil soluble antimony compound and an oil soluble antioxidant selected from sterically hindered phenols and thiophenols, and aromatic amines, and mixtures of these antioxidants. U.S. Pat. No. 4,089,792 discloses lubricants having a an antioxidant mixture of a primary amine and an antioxidant selected from aromatic or alkyl sulfides and polysulfides, sulfurized olefins, sulfurized carboxylic acid esters and sulfurized ester-olefins. U.S. Pat. No. 4,102,796 discloses lubricants having an antioxidant mixture of aromatic and alkyl sulfides and polysulfides, sulfurized olefins, sulfurized carboxylic acid esters and sulfurized ester-olefins and a secondary aliphatic amine. U.S. Pat. No. 6,306,802 discloses of an antioxidant mixture containing a combination of an oil soluble molybdenum compound and an aromatic amine.

Commonly, antioxidant compounds which were intended to decompose hydroperoxides or peroxides (including sulfurized olefins, metal dithiocarbamates, dithiophospates, phosphites, thioesters, etc.) are increasingly difficult to incorporate into the finished lubricant due to the undesirable amounts of sulfur, phosphorous and ash content they add to the lubricating oil composition. It is known that sulfur, phosphorous and ash content may negatively impact pollution control devices (such as poisoning catalysts, etc.) which are finding increasing application. Thus, there is a need for new antioxidants and antioxidant systems which do not negatively impact pollution control equipment yet provide improved antioxidancy performance to handle the typical higher operating temperatures and longer service life desired. Synergistic antioxidant systems are particularly important since they reduce the overall additive impact. For example, some antioxidants such as diphenylamines cannot be used at relatively high concentrations since this may result in sedimentation or deposits in hot engine areas such as the diesel ring areas in diesel engines. Thus, one aspect of the invention is directed to an improved antioxidant system comprising a free radical antioxidant and an effective peroxide decomposer selected from an tetraalkylnaphthalene-1,8-diamine.

SUMMARY OF THE INVENTION

The present is directed in part to a lubricating oil composition which provides improved oxidation stability. Accordingly the compositions of the present invention have various uses such as lubricants for automotive and truck crankcase lubricants; as well as transmission lubricants, gear lubricants, hydraulic fluids, compressor oils, diesel and marine lubricants. The lubricating oil compositions of the present invention comprise at least one oil of lubricating viscosity, an oil soluble antioxidant according to formula I:

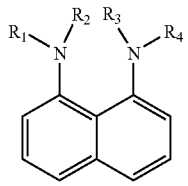

wherein $R_1$, $R_2$, $R_3$ and $R_4$ are each independently selected from alkyl groups each having from 1 to 20 carbon atoms, and at least one additive selected from antioxidants, dispersants, and detergents. The antioxidant according to formula I is effective by itself when employed in a lubricating composition. However, there is an improvement in antioxidancy performance when the compounds of formula I are employed with a free radical antioxidant. Thus another aspect is directed to a lubricating oil composition comprising an oil of lubricating viscosity and an antioxidant is a mixture comprising: a) from 0.1 to 10 weight percent of a first antioxidant according to formula I:

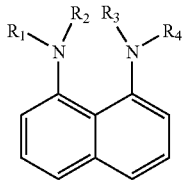

wherein $R_1$, $R_2$, $R_3$ and $R_4$ are each independently selected from alkyl groups each having from 1 to 20 carbon atoms; and b) from 0.01 to 10 weight percent of a second antioxidant selected from the formula

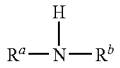

wherein $R^a$ and $R^b$ are each independently aryl from 6 to 10 carbon atoms which may be unsubstituted or substituted with one or two alkyl groups each having from 1 to 20 carbon atoms.

Improvement of the combination of component a) and component b) is demonstrated at ratios of component a) to component b) from about 0.5:1 to about 10:1 and even more particularly from about 0.75:1 to about 5.1. Due to the demonstrated improvement in oxidative stability of the composition afforded by the mixture of components a) & b), the mixture of these components present in the total composition is less than 5 weight percent. More preferably the mixture of a) & b) is from 0.5 to 2.0 weight percent based on the total weight of the composition.

The composition defined above can contain other additives. Thus another aspect of the present invention further comprises an oil soluble molybdenum compound. A particularly preferred oil soluble molybdenum compound is an unsulfurized or sulfurized oxymolybdenum containing composition prepared by (i) reacting an acidic molybdenum compound and a basic nitrogen compound selected from the dispersant group consisting of succinimide, a carboxylic acid amide, a hydrocarbyl monoamine, a phosphoramide, a thiophosphoramide, a Mannich base, a dispersant viscosity index improver, or a mixture thereof in the presence of a polar promoter, to form an oxymolybdenum complex. More preferably the basic nitrogen compound is a succinimide.

The composition above can further comprise an oil-soluble, phosphorus-containing, anti-wear compound selected from the group consisting of metal dithiophosphates, phosphorus esters, amine phosphates and amine phosphinates, sulfur-containing phosphorus esters, phosphoramides and phosphonamides. Preferred said phosphorus esters are selected from the group consisting of phosphates, phosphonates, phosphinates, phosphine oxides, phosphites, phosphonites, phosphinites, and phosphines. Particularly preferred oil-soluble, phosphorus-containing, anti-wear compound is a metal dithiophosphate, such as zinc dialkyldithiophosphate.

Further provided is a method for lubricating an internal combustion engine comprising supplying the lubricant composition described herein above to the engine. As noted, the compounds of formula I are useful as antioxidants, thus one aspect is directed to the use of the compounds of formula I in a lubricating oil composition for oxidation retardation purposes.

DETAILED DESCRIPTION OF THE INVENTION

Inhibition of free radical-mediated oxidation is one of the most important reactions in organic substrates and is commonly used in rubbers, polymers and lubrication oils; namely, since these chemical products may undergo oxidative damage by the autoxidation process. Hydrocarbon oxidation is a three step process which comprises: initiation, propagation and termination. Oxidative degradation and the reaction mechanisms are dependent upon the specific hydrocarbons, temperatures, operating conditions, catalysts such as metals, etc., which more detail can be found in Chapter 4 of Mortier R. M. et al., 1992, "Chemistry and Technology of Lubricants Initiation", VCH Publishers, Inc.; incorporated herein by reference in its entirety. Initiation involves the reaction of oxygen or nitrogen oxides ($NO_x$) on a hydrocarbon molecule. Typically, initiation starts by the abstraction of hydrocarbon proton. This may result in the formation of hydrogen peroxide (HOOH) and radicals such as alkyl radicals (R.) and peroxy radicals (ROO.). During the propagation stage, hydroperoxides may decompose, either on their own or in the presence of catalysts such as metal ions, to alkoxy radicals (RO.) and peroxy radicals. These radicals can react with the hydrocarbons to form a variety of additional radicals and reactive oxygen containing compounds such as alcohols, aldehydes, ketones and carboxylic acids; which again can further polymerize or continue chain propagation. Termination results from the self termination of radicals or by reacting with oxidation inhibitors.

The uncatalyzed oxidation of hydrocarbons at temperatures of up to about 120° C. primarily leads to alkyl-hydroperoxides, dialkylperoxides, alcohols, ketones; as well as the products which result from cleavage of dihydroperoxides such as diketones, keto-aldehydes hydroxyketones and so forth. At higher temperatures (above 120° C.) the reaction rates are increased and cleavage of the hydroperoxides plays a more important role. Additionally, at the higher temperatures, the viscosity of the bulk medium increases as a result of the polycondensation of the difunctional oxygenated products formed in the primary oxidation phase. Further polycondensation and polymerization reaction of these high molecular weight intermediates results in products which are no longer soluble in the hydrocarbon and form varnish like deposits and sludge.

Since autoxidation is a free-radical chain reaction, it therefore, can be inhibited at the initiation and/or propagation steps. Typical oxidation inhibition by diarylamines, such as dialkyldiphenylamine and N-phenyl-α-napthylamine, also involves radical scavenging. The transfer of hydrogen from the NH group of the amine to the peroxide radicals results in the formation of a diarylamino radical which is resonance stabilized, thus prevents new chains from forming. A secondary peroxy radical or hydroperoxide can react with the diarylamino radical to form the nitroxy radical, which is also a very potent inhibitor. Hydroperoxide decomposers convert the hydroperoxides into non-radical products and thus prevent the chain propagation reaction. Traditionally organosulfur and organophosphorous containing additives have been employed for this purpose typically eliminating hydroperoxides via acid catalyzed decomposition or oxygen transfer. However as mentioned previously, increased concerns regarding total sulfur and/or phosphorous content in finished lubricating oil has led to efforts to find new hydroperoxide decomposers perhaps those that even react by a different mechanism. Also, increased demands have been placed on many functional fluids which have in-turn placed emphasis on new inhibitors.

The present invention is directed in part to a lubricating oil composition having an suitable oil of lubricating viscosity and a first component a) is a N,N,N',N'-tetraalkyl-naphthalene-1,8-diamine compound which can serve as a particularly useful as a stabilizer and thus is typically employed with at least on other additive. Particularly applicable is component a) in combination with another antioxidant and moreover with component b) a secondary aryl amine, the combination has improved oxidation stability. Synergism has been suggested for combinations of different types of antioxidants also called heterosynergism due to the different mechanism of stabilizer, for example a combination of radical scavengers and peroxide decomposers. Additionally, it has been suggested even within the same class, compounds which act by a different reaction mechanism/rate may lead to synergistic results, for example combinations of hindered phenolics and alkylated diphenylamines has been studied. Heretofore, antioxidancy in lubricating oil had not be demonstrated for N,N,N',N'-tetraalkyl-naphthalene-1,8-diamine nor has synergism been demonstrated for a mixture of a) N,N,N',N'-tetraalkyl-naphthalene-1,8-diamine and b) a secondary aryl amine.

N,N,N',N'-Tetraalkyl-naphthalene-1,8-diamine—Component a)

Component a) is a N,N,N',N'-tetraalkyl-naphthalene-1,8-diamine which alone is particularly useful as an antioxidant and thus suited for use an antioxidant in a lubricating oil composition typically combined with other additives such as antioxidants, detergents and dispersants. Disclosed are particularly suited sterically hindered amine compounds according to formula I:

Formula I

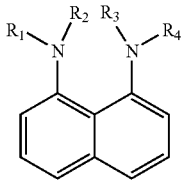

wherein: $R_1$ and $R_2$ and $R_3$ and $R_4$ are each independently selected from the group consisting of alkyl from 1 to 20 carbon atoms, more preferably alkyl from 1 to 10 carbon atoms and even more preferably lower alkyl from 1 to six carbon atoms. The alkyl groups above, can have either a straight chain or a branched chain, which are fully saturated hydrocarbon chain; for example, methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, and the like, and isomers and mixtures thereof An example of a suitable hindered amine that may be used in the present invention is N,N,N',N'-tetramethyl-naphthalene-1,8-diamine and sold by Sigma-Aldrich as Protonsponge™. The N,N,N',N'-tetramethyl-naphthalene-1,8-diamine is a strained molecule due to the close proximity to the dimethylamine groups. The free base is destabilized by the steric inhibition of resonance, van der Walls repulsions, and lone pair interactions. These strains are typically relieved by monoprotonation and formation of an intramolecular hydrogen bond and thus can effectively alter the equilibrium constant of the hydroperoxide decomposition reaction. This imparts a high basicity relative to normal aliphatic amines or aromatic amines and which is necessary to deprotonate a hydroperoxide. Deprotonation of the peroxide would render the oxygen-oxygen bond more stable toward decomposition into radicals. The strong basicity of the N,N,N',N'-tetramethyl-naphthalene-1,8-diamine can be ascribed to the operation of several factors, e.g. the steric inhibition of conjugation in the free base, relief of nonbonded repulsions, including a little lone pair/lone pair repulsion, stabilization of the cation by the hydrogen bonding, etc. Clearly the N,N,N',N'-tetramethyl-naphthalene-1,8-diamine structure is compromise involving several factors including a twist in the naphthalene ring system, favorable lone pair/π overlap, lone pair/methyl nonbonded interactions, and lone pair/lone pair repulsion.

The compounds of formula I are selected with sufficient alkyl groups to be oil soluble in the lubricating composition and thus the compound of formula I are combined with an oil of lubricating viscosity. The concentration of the compound of formula I in the lubricating composition can vary depending upon the requirements, applications and effect or degree of synergy desired. In a preferred embodiment of the invention, a practical N,N,N',N'-tetraalkyl-naphthalene-1,8-diamine use range in the lubricating composition is from about 1,000 parts per million to 20,000 parts per million (i.e. 0.1 to 2.0 wt %) based on the total weight of the lubricating oil composition, preferably the concentration is from 1,000 to 15,000 parts per million (ppm) and more preferably from about 3,000 to 10,000 ppm by weight.

The N,N,N',N'-tetraalkyl-naphthalene-1,8-diamine compound of formula I can be used as a complete or partial replacement for commercially available antioxidants currently used in lubricant formulations and can be in combination with other additives typically found in motor oils and fuels. When used in combination with other types of antioxidants or additives used in oil formulations, synergistic and/or additive performance effects may also be obtained with respect to improved antioxidancy, antiwear, frictional and detergency and high temperature engine deposit properties. Such other additives can be any presently known or later-discovered additives used in formulating lubricating oil compositions. The lubricating oil additives typically found in lubricating oils are, for example, dispersants, detergents, corrosion/rust inhibitors, antioxidants, anti-wear agents, anti-foamants, friction modifiers, seal swell agents, emulsifiers, VI improvers, pour point depressants, and the like. Particularly preferred to a demonstrated synergy is the compounds of component a) with an additional antioxidant such as a free radical inhibitor antioxidant, even more preferably selected from diarylamines or hindered phenolic types and combinations thereof.

In general, the concentration of each of the additives in the lubricating oil composition, when used, may range from about 0.001 wt. % to about 10 wt. %, from about 0.01 wt. % to about 5 wt. %, or from about 0.1 wt. % to about 2.5 wt. %, based on the total weight of the lubricating oil composition. Further, the total amount of the additives in the lubricating oil composition may range from about 0.001 wt. % to about 40 wt. %, from about 0.01 wt. % to about 20 wt. %, or from about 0.1 wt. % to about 10 wt. %, based on the total weight of the lubricating oil composition.

Diarylamine—component b):

The secondary diarylamines are well known antioxidants. Preferably, the secondary diarylamine antioxidant is one of the formula $R^a$—NH—$R^b$, wherein $R^a$ and $R^b$ each independently represent a substituted or unsubstituted aryl group having from $C_6$ to $C_{30}$ carbon atoms, preferably $R^a$ and $R^b$ are each independently aryl from 6 to 10 carbon atoms which may be unsubstituted or substituted with one or two alkyl groups each having from 1 to 20 carbon atoms.

Illustrative of substituents for the aryl moieties are aliphatic hydrocarbon groups, such as alkyl or alkenyl of 1 to 20 carbon atoms. The aryl moieties are preferably substituted or unsubstituted phenyl or substituted or unsubstituted naphthyl, particularly where one or both of the aryl moieties are substituted with alkyl, such as one having 4 to 18 carbon atoms.

The aliphatic hydrocarbon moiety, which can be of 1 to 20 carbon atoms, can have either a straight chain or a branched chain for example, methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, and the like, and isomers and mixtures thereof.

Preferably either $R^a$ and/or $R^b$ contain substituted aryl groups. These secondary diarylamines may be substituted at one or both rings with alkyl groups, preferably straight and branched alkyl groups from 4 to 12 carbon atoms, more preferably 8 to 9 carbon atoms. Commonly mixtures of alkylated diphenylamines are prepared such as that prepared by reacting diphenylamine with 2,4,4-trimethylpentyl; or employing other alkyl groups, preferably branched chain to prepare for example nonylated diphenylamine (bis(4-nonylphenyl)amine) or octylated-butylated diphenyl amine.

For exhibiting good solubility of their oxidized product in base oil, these aliphatic hydrocarbon moieties comprise $C_{20}$ or less alkyl groups, preferably $C_{8-16}$ branched alkyl groups, more preferably those $C_{8-16}$ branched alkyl groups derived from oligomers of $C_3$ or $C_4$ olefins. The $C_3$ or $C_4$ olefins referred to here include propylene, 1-butene, 2-butene and isobutylene, among which propylene and isobutylene are preferable for good solubility of their oxidized product in base oil. Specifically, a branched octyl group derived from an isobutylene dimer, a branched nonyl group derived from a propylene trimer, a branched dodecyl group derived from an isobutylene trimer, a branched dodecyl group derived from a propylene tetramer or a branched pentadecyl group derived from a propylene pentamer is particularly preferable. The substituted secondary diaryl amines and particularly p,p'-dialkyl diphenyl amines and N-p-alkylphenyl-α-naphthyl amines, may be a commercially available product, but can be easily produced by reacting the diaryl amine with a $C_{1-6}$ alkyl halide, a $C_{2-6}$ olefin, or a $C_{2-6}$ olefin oligomer with secondary diaryl amine by use of a Friedel-Crafts catalyst. Examples of the Friedel-Crafts catalyst are metal halides such as aluminum chloride, zinc chloride and iron chloride, and acidic catalysts such as sulfuric acid, phosphoric acid, phosphorus pentoxide, boron fluoride, acidic clay and active clay. Other alkylation methods are known in the art.

Examples of some of the secondary diarylamines that are useful in the practice of the present invention include: diphenylamine, monoalkylated diphenylamine, dialkylated diphenylamine, trialkylated diphenylamine, or mixtures thereof, mono- and/or di-butyldiphenylamine, mono- and/or di-octyldiphenylamine, mono- and/or di-nonyldiphenylamine, phenyl-alpha-naphthylamine, phenyl-beta-naphthylamine, diheptyldiphenylamine, t-octylated N-phenyl-1-naphthylamine, mixtures of mono- and dialkylated t-butyl-t-octyldiphenylamine.

Examples of commercial diarylamines include, for example, IRGANOX L06, IRGANOX L57 and IRGANOX L67 from Ciba Specialty Chemicals; NAUGALUBE AMS, NAUGALUBE 438, NAUGALUBE 438R, NAUGALUBE 438L, NAUGALUBE 500, NAUGALUBE 640, NAUGALUBE 680, and NAUGARD PANA from Crompton Corporation; GOODRITE 3123, GOODRITE 3190X36, GOODRITE 3127, GOODRITE 3128, GOODRITE 3185X1, GOODRITE 3190X29, GOODRITE 3190X40, GOODRITE 3191 and GOODRITE 3192 from BF Goodrich Specialty Chemicals; VANLUBE DND, VANLUBE NA, VANLUBE PNA, VANLUBE SL, VANLUBE SLHP, VANLUBE SS, VANLUBE 81, VANLUBE 848, and VANLUBE 849 from R. T. Vanderbilt Company Inc.

The concentration of the secondary diarylamine in the lubricating composition can vary depending upon the requirements, applications and degree of synergy desired. In a preferred embodiment of the invention, a practical secondary diarylamine use range in the lubricating composition is from about 1,000 parts per million to 20,000 parts per million (i.e. 0. 1 to 2.0 wt %) based on the total weight of the lubricating oil composition, preferably the concentration is from 1,000 to 15,000 parts per million (ppm) and more preferably from about 3,000 to 10,000 ppm by weight.

Typically, with regard to total antioxidant in the lubricating composition, quantities of less than 1,000 ppm have little or minimal effectiveness whereas quantities larger than 50,000 ppm are generally not economical. Preferably the total amount of component a) and component b) in the lubricating oil composition is from about 0. 1 to 2 wt % and more preferably from about 0.5 to about 2 wt % based upon the total weight of the lubricating oil composition.

Other oxidation inhibitors which can be used with the compounds of formula I include but are not limited to hindered phenols, sulfurized hindered phenols, hindered phenolic esters, alkylated phenothiazines, and ashless dialkylthiocarbamates. Tertiary alkylated monohydric phenols are widely employed typically with a tertiary alkyl group in the ortho (and optionally meta and/or para position) containing from 4 to 12 carbon atoms and are depicted for example in U.S. Pat. No. 2,831,898. Methylene-bridged tertiary alkyl polyphenols be utilized such as prepared in U.S. Pat. No. 3,211,652. Phenol type phenolic oxidation inhibitors: 4,4'-methylenebis(2,6-di-tert-butylphenol), 4,4'-bis(2,6-di-tert-butylphenol), 4,4'-bis(2-methyl-6-tert-butylphenol), 2,2'-(methylenebis(4-methyl-6-tert-butyl-phenol)), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-tert-butyl-4-methylphenol, 2,6-di-tert-butyl4-ethylphenol, 2,4-dimethyl-6-tert-butyl-phenol, 2,6-di-tert-alpha-dimethylamino-p-cresol, 2,6-di-tert-4(N, N'dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis (3,5-di-tert-butyl4-hydroxybenzyl).

The lubricating oil composition disclosed herein can optionally comprise an anti-wear agent that can reduce friction and excessive wear. Any anti-wear agent known by a person of ordinary skill in the art may be used in the lubricating oil composition. Non-limiting examples of suitable anti-wear agents include zinc dithiophosphate, metal (e.g., Pb, Sb, Mo and the like) salts of dithiophosphate, metal (e.g. Zn, Pb, Sb, Mo and the like) salts of dithiocarbamate, metal (e.g., Zn, Pb, Sb and the like) salts of fatty acids, boron compounds, phosphate esters, phosphite esters, amine salts of phosphoric acid esters or thiophosphoric acid esters, reaction products of dicyclopentadiene and thiophosphoric acids and combinations thereof. The amount of the anti-wear agent may vary from about 0.01 wt. % to about 5 wt. %, from about 0.05 wt. % to about 3 wt. %, or from about 0.1 wt. % to about 1 wt. %, based on the total weight of the lubricating oil composition. Some suitable anti-wear agents have been described in Leslie R. Rudnick, "Lubricant Additives: Chemistry and Applications," New York, Marcel Dekker, Chapter 8, pages 223-258 (2003), which is incorporated herein by reference.

In certain embodiments, the anti-wear agent is or comprises a dihydrocarbyl dithiophosphate metal salt, such as zinc dialkyl dithiophosphate compounds. The metal of the dihydrocarbyl dithiophosphate metal salt may be an alkali or alkaline earth metal, or aluminum, lead, tin, molybdenum, manganese, nickel or copper. In some embodiments, the metal is zinc. In other embodiments, the alkyl group of the dihydrocarbyl dithiophosphate metal salt has from about 3 to about 22 carbon atoms, from about 3 to about 18 carbon atoms, from about 3 to about 12 carbon atoms, or from about 3 to about 8 carbon atoms. In further embodiments, the alkyl group is linear or branched.

The amount of the dihydrocarbyl dithiophosphate metal salt including the zinc dialkyl dithiophosphate salts in the lubricating oil composition disclosed herein is measured by its phosphorus content. In some embodiments, the phosphorus content of the lubricating oil composition disclosed herein is from about 0.01 wt. % to about 0.12 wt. %, from about 0.01 wt. % to about 0.10 wt. %, or from about 0.02 wt. % to about 0.08 wt. %, based on the total weight of the lubricating oil composition.

In one embodiment, the phosphorous content of the lubricating oil composition herein is from about 0.01 to 0.08wt % based on the total weight of the lubricating oil composition. In another embodiment, the phosphorous content of the lubricating oil composition herein is from about 0.05 to 0. 12 wt % based on the total weight of the lubricating oil composition.

The dihydrocarbyl dithiophosphate metal salt may be prepared in accordance with known techniques by first forming a dihydrocarbyl dithiophosphoric acid (DDPA), usually by reacting one or more of alcohols and phenolic compounds with $P_2S_5$ and then neutralizing the formed DDPA with a compound of the metal, such as an oxide, hydroxide or carbonate of the metal. In some embodiments, a DDPA may be made by reacting mixtures of primary and secondary alcohols with $P_2S_5$. In other embodiments, two or more dihydrocarbyl dithiophosphoric acids can be prepared where the hydrocarbyl groups on one are entirely secondary in character and the hydrocarbyl groups on the others are entirely primary in character. The zinc salts can be prepare from the dihydrocarbyl dithiophosphoric acids by reacting with a zinc compound. In some embodiments, a basic or a neutral zinc compound is used. In other embodiments, an oxide, hydroxide or carbonate of zinc is used.

In some embodiments, oil soluble zinc dialkyl dithiophosphates may be produced from dialkyl dithiophosphoric acids represented by formula (II):

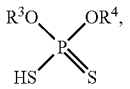

(II)

wherein each of $R^3$ and $R^4$ is independently linear or branched alkyl or linear or branched substituted alkyl. In some embodiments, the alkyl group has from about 3 to about 30 carbon atoms or from about 3 to about 8 carbon atoms.

The dialkyldithiophosphoric acids of formula (II) can be prepared by reacting alcohols $R^3OH$ and $R^4OH$ with $P_2S_5$ where $R^3$ and $R^4$ are as defined above. In some embodiments, $R^3$ and $R^4$ are the same. In other embodiments, $R^3$ and $R^4$ are different. In further embodiments, $R^3OH$ and $R^4OH$ react with $P_2S_5$ simultaneously. In still further embodiments, $R^3OH$ and $R^4OH$ react with $P_2S_5$ sequentially.

Mixtures of hydroxyl alkyl compounds may also be used. These hydroxyl alkyl compounds need not be monohydroxy alkyl compounds. In some embodiments, the dialkyldithiophosphoric acids is prepared from mono-, di-, tri-, tetra-, and other polyhydroxy alkyl compounds, or mixtures of two or more of the foregoing. In other embodiments, the zinc dialkyldithiophosphate derived from only primary alkyl alcohols is derived from a single primary alcohol. In further embodiments, that single primary alcohol is 2-ethylhexanol. In certain embodiments, the zinc dialkyldithiophosphate derived from only secondary alkyl alcohols. In further embodiments, that mixture of secondary alcohols is a mixture of 2-butanol and 4-methyl-2-pentanol.

The phosphorus pentasulfide reactant used in the dialkyldithiophosphoric acid formation step may contain certain amounts of one or more of $P_2S_3$, $P_4S_3$, $P_4S_7$, or $P_4S_9$. Compositions as such may also contain minor amounts of free sulfur. In certain embodiments, the phosphorus pentasulfide reactant is substantially free of any of $P_2S_3$, $P_4S_3$, $P_4S_7$, and $P_4S_9$. In certain embodiments, the phosphorus pentasulfide reactant is substantially free of free sulfur.

In the present invention, the sulfated ash content of the total lubricating oil composition is about 5 wt. %, about 4 wt. %, about 3 wt. %, about 2 wt. %, or about 1 wt. %, as measured according to ASTM D874.

In some embodiments, the lubricating oil composition comprises at least a detergent. Any compound or a mixture of compounds that can reduce or slow the build up of engine deposits can be used as a detergent. Some non-limiting examples of suitable detergents include polyolefin substituted succinimides or succinamides of polyamines, for instance polyisobutylene succinimides or polyisobutylene amine succinamides, aliphatic amines, Mannich bases or amines and polyolefin (e.g. polyisobutylene) maleic anhydrides. Some suitable succinimide detergents are described in GB960493, EP0147240, EP0482253, EP0613938, EP0557561 and WO 98/42808, all of which are incorporated herein by reference. In some embodiments, the detergent is a polyolefin substituted succinimide such as polyisobutylene succinimide. Some non-limiting examples of commercially available detergent additives include F7661 and F7685 (available from Infineum, Linden, N.J.) and OMA 4130D (available from Octel Corporation, Manchester, UK).

Some non-limiting examples of suitable metal detergent include sulfurized or unsulfurized alkyl or alkenyl phenates, alkyl or alkenyl aromatic sulfonates, borated sulfonates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and chemical and physical mixtures thereof. Other non-limiting examples of suitable metal detergents include metal sulfonates, phenates, salicylates, phosphonates, thiophosphonates and combinations thereof. The metal can be any metal suitable for making sulfonate, phenate, salicylate or phosphonate detergents. Non-limiting examples of suitable metals include alkali metals, alkaline metals and transition metals. In some embodiments, the metal is Ca, Mg, Ba, K, Na, Li or the like.

Generally, the amount of the detergent is from about 0.001 wt. % to about 5 wt. %, from about 0.05 wt. % to about 3 wt. %, or from about 0. 1 wt. % to about 1 wt. %, based on the total weight of the lubricating oil composition. Some suitable detergents have been described in Mortier et al., "*Chemistry and Technology of Lubricants,*" 2nd Edition, London, Springer, Chapter 3, pages 75-85 (1996); and Leslie R. Rudnick, "*Lubricant Additives: Chemistry and Applications*," New York, Marcel Dekker, Chapter 4, pages 113-136 (2003), both of which are incorporated herein by reference.

The lubricating oil composition disclosed herein can optionally comprise a dispersant that can prevent sludge, varnish, and other deposits by keeping particles suspended in a colloidal state. Any dispersant known by a person of ordinary skill in the art may be used in the lubricating oil composition. Non-limiting examples of suitable dispersants include alkenyl succinimides, alkenyl succinimides modified with other organic compounds, alkenyl succinimides modified by post-treatment with ethylene carbonate or boric acid, succiamides, succinate esters, succinate ester-amides, pentaerythritols, phenate-salicylates and their post-treated analogs, alkali metal or mixed alkali metal, alkaline earth metal borates, dispersions of hydrated alkali metal borates, dispersions of alkaline-earth metal borates, polyamide ashless dispersants, benzylamines, Mannich type dispersants, phosphorus-containing dispersants, and combinations thereof The amount of the dispersant may vary from about 0.01 wt. % to about 10 wt. %, from about 0.05 wt. % to about 7 wt. %, or from about 0.1 wt. % to about 4 wt. %, based on the total weight of the lubricating oil composition. Some suitable dispersants have been described in Mortier et al., "*Chemistry and Technology ofLubricants,*" 2nd Edition, London, Springer, Chapter 3, pages 86-90 (1996); and Leslie R. Rudnick, "*Lubricant Additives: Chemistry and Applications*," New York, Marcel Dekker, Chapter 5, pages 137-170 (2003), both of which are incorporated herein by reference.

The lubricating oil composition disclosed herein can optionally comprise a friction modifier that can lower the friction between moving parts. Any friction modifier known by a person of ordinary skill in the art may be used in the lubricating oil composition. Non-limiting examples of suitable friction modifiers include fatty carboxylic acids; derivatives (e.g., alcohol, esters, borated esters, amides, metal salts and the like) of fatty carboxylic acid; mono-, di- or tri-alkyl substituted phosphoric acids or phosphonic acids; derivatives (e.g., esters, amides, metal salts and the like) of mono-, di- or tri-alkyl substituted phosphoric acids or phosphonic acids; mono-, di- or tri-alkyl substituted amines; mono- or di-alkyl substituted amides and combinations thereof. In some embodiments, the friction modifier is selected from the group consisting of aliphatic amines, ethoxylated aliphatic amines, aliphatic carboxylic acid amides, ethoxylated aliphatic ether amines, aliphatic carboxylic acids, glycerol esters, aliphatic carboxylic ester-amides, fatty imidazolines, fatty tertiary amines, wherein the aliphatic or fatty group contains more than about eight carbon atoms so as to render the compound suitably oil soluble. In other embodiments, the friction modifier comprises an aliphatic substituted succinimide formed by reacting an aliphatic succinic acid or anhydride with ammonia or a primary amine. The amount of the friction modifier may vary from about 0.01 wt. % to about 10 wt. %, from about 0.05 wt. % to about 5 wt. %, or from about 0. 1 wt. % to about 3 wt. %, based on the total weight of the lubricating oil composition. Some suitable friction modifiers have been described in Mortier et al., "*Chemistry and Technology of Lubricants,*" 2nd Edition, London, Springer, Chapter 6, pages 183-187 (1996); and Leslie R. Rudnick, "Lubricant Additives: Chemistry and Applications," New York, Marcel Dekker, Chapters 6 and 7, pages 171-222 (2003), both of which are incorporated herein by reference.

The lubricating oil composition disclosed herein can optionally comprise a pour point depressant that can lower the pour point of the lubricating oil composition. Any pour point depressant known by a person of ordinary skill in the art may be used in the lubricating oil composition. Non-limiting examples of suitable pour point depressants include polymethacrylates, alkyl acrylate polymers, alkyl methacrylate polymers, di(tetra-paraffin phenol)phthalate, condensates of tetra-paraffin phenol, condensates of a chlorinated paraffin with naphthalene and combinations thereof. In some embodiments, the pour point depressant comprises an ethylene-vinyl acetate copolymer, a condensate of chlorinated paraffin and phenol, polyalkyl styrene or the like. The amount of the pour point depressant may vary from about 0.01 wt. % to about 10 wt. %, from about 0.05 wt. % to about 5 wt. %, or from about 0.1 wt. % to about 3 wt. %, based on the total weight of the lubricating oil composition. Some suitable pour point depressants have been described in Mortier et al., "Chemistry and Technology ofLubricants," 2nd Edition, London, Springer, Chapter 6, pages 187-189 (1996); and Leslie R. Rudnick, "*Lubricant Additives: Chemistry and Applications*," New York, Marcel Dekker, Chapter 11, pages 329-354 (2003), both of which are incorporated herein by reference.

The lubricating oil composition disclosed herein can optionally comprise a demulsifier that can promote oil-water separation in lubricating oil compositions that are exposed to water or steam. Any demulsifier known by a person of ordinary skill in the art may be used in the lubricating oil composition. Non-limiting examples of suitable demulsifiers include anionic surfactants (e.g., alkyl-naphthalene sulfonates, alkyl benzene sulfonates and the like), nonionic alkoxylated alkylphenol resins, polymers of alkylene oxides (e.g., polyethylene oxide, polypropylene oxide, block copolymers of ethylene oxide, propylene oxide and the like), esters of oil soluble acids, polyoxyethylene sorbitan ester and combinations thereof The amount of the demulsifier may vary from about 0.01 wt. % to about 10 wt. %, from about 0.05 wt. % to about 5 wt. %, or from about 0. 1 wt. % to about 3 wt. %, based on the total weight of the lubricating oil composition. Some suitable demulsifiers have been described in Mortier et al., "*Chemistry and Technology of Lubricants,*" 2nd Edition, London, Springer, Chapter 6, pages 190-193 (1996), which is incorporated herein by reference.

The lubricating oil composition disclosed herein can optionally comprise a foam inhibitor or an anti-foam that can break up foams in oils. Any foam inhibitor or anti-foam known by a person of ordinary skill in the art may be used in the lubricating oil composition. Non-limiting examples of suitable anti-foams include silicone oils or polydimethylsiloxanes, fluorosilicones, alkoxylated aliphatic acids, polyethers (e.g., polyethylene glycols), branched polyvinyl ethers, alkyl acrylate polymers, alkyl methacrylate polymers, polyalkoxyamines and combinations thereof. In some embodiments, the anti-foam comprises glycerol monostearate, polyglycol palmitate, a trialkyl monothiophosphate, an ester of sulfonated ricinoleic acid, benzoylacetone, methyl salicylate, glycerol monooleate, or glycerol dioleate. The amount of the anti-foam may vary from about 0.01 wt. % to about 5 wt. %, from about 0.05 wt. % to about 3 wt. %, or from about 0. 1 wt. % to about 1 wt. %, based on the total weight of the lubricating oil composition. Some suitable anti-foams have been described in Mortier et al., "*Chemistry and Technology of Lubricants,*" 2nd Edition, London, Springer, Chapter 6, pages 190-193 (1996), which is incorporated herein by reference.

The lubricating oil composition disclosed herein can optionally comprise a corrosion inhibitor that can reduce corrosion. Any corrosion inhibitor known by a person of ordinary skill in the art may be used in the lubricating oil composition. Non-limiting examples of suitable corrosion inhibitor include half esters or amides of dodecylsuccinic acid, phosphate esters, thiophosphates, alkyl imidazolines, sarcosines and combinations thereof. The amount of the corrosion inhibitor may vary from about 0.01 wt. % to about 5 wt. %, from about 0.05 wt. % to about 3 wt. %, or from about 0.1 wt. % to about 1 wt. %, based on the total weight of the lubricating oil composition. Some suitable corrosion inhibitors have been described in Mortier et al., "Chemistry and Technology of Lubricants," 2nd Edition, London, Springer, Chapter 6, pages 193-196 (1996), which is incorporated herein by reference.

The lubricating oil composition disclosed herein can optionally comprise an extreme pressure (EP) agent that can prevent sliding metal surfaces from seizing under conditions of extreme pressure. Any extreme pressure agent known by a person of ordinary skill in the art may be used in the lubricating oil composition. Generally, the extreme pressure agent is a compound that can combine chemically with a metal to form a surface film that prevents the welding of asperities in opposing metal surfaces under high loads. Non-limiting examples of suitable extreme pressure agents include sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and polysulfide olefin products, amine salts of phosphoric acid esters or thiophosphoric acid esters and combinations thereof. The amount of the extreme pressure agent may vary from about 0.01 wt. % to about 5 wt. %, from about 0.05 wt. % to about 3 wt. %, or from about 0.1 wt. % to about 1 wt. %, based on the total weight of the lubricating oil composition. Some suitable extreme pressure agents have been described in Leslie R. Rudnick, "*Lubricant Additives: Chemistry and Applications*," New York, Marcel Dekker, Chapter 8, pages 223-258 (2003), which is incorporated herein by reference.

The lubricating oil composition disclosed herein can optionally comprise a rust inhibitor that can inhibit the corrosion of ferrous metal surfaces. Any rust inhibitor known by a person of ordinary skill in the art may be used in the lubricating oil composition. Non-limiting examples of suitable rust inhibitors include oil-soluble monocarboxylic acids (e.g., 2-ethylhexanoic acid, lauric acid, myristic acid, palmitic acid, oleic acid, linoleic acid, linolenic acid, behenic acid, cerotic acid and the like), oil-soluble polycarboxylic acids (e.g., those produced from tall oil fatty acids, oleic acid, linoleic acid and the like), alkenylsuccinic acids in which the alkenyl group contains 10 or more carbon atoms (e.g., tetrapropenylsuccinic acid, tetradecenylsuccinic acid, hexadecenylsuccinic acid, and the like); long-chain alpha,omega-dicarboxylic acids having a molecular weight in the range of 600 to 3000 daltons and combinations thereof. The amount of the rust inhibitor may vary from about 0.01 wt. % to about 10 wt. %, from about 0.05 wt. % to about 5 wt. %, or from about 0. 1 wt. % to about 3 wt. %, based on the total weight of the lubricating oil composition.

Other non-limiting examples of suitable rust inhibitors include nonionic polyoxyethylene surface active agents such as polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol mono-oleate, and polyethylene glycol mono-oleate. Further non-limiting examples of suitable rust inhibitor include stearic acid and other fatty acids, dicarboxylic acids, metal soaps, fatty acid amine salts, metal salts of heavy sulfonic acid, partial carboxylic acid ester of polyhydric alcohol, and phosphoric ester.

In some embodiments, the lubricating oil composition comprises at least a multifunctional additive. Some non-limiting examples of suitable multifunctional additives include sulfurized oxymolybdenum dithiocarbamate, sulfurized oxymolybdenum organophosphorodithioate, oxymolybdenum monoglyceride, oxymolybdenum diethylate amide, amine-molybdenum complex compound, and sulfur-containing molybdenum complex compound.

In certain embodiments, the lubricating oil composition comprises at least a viscosity index improver. Some non-limiting examples of suitable viscosity index improvers include polymethacrylate type polymers, ethylene-propylene copolymers, styrene-isoprene copolymers, hydrated styrene-isoprene copolymers, polyisobutylene, and dispersant type viscosity index improvers.

In some embodiments, the lubricating oil composition comprises at least a metal deactivator. Some non-limiting examples of suitable metal deactivators include disalicylidene propylenediamine, triazole derivatives, thiadiazole derivatives, and mercaptobenzimidazoles.

The additives disclosed herein may be in the form of an additive concentrate having more than one additive. The additive concentrate may comprise a suitable diluent, such as a hydrocarbon oil of suitable viscosity. Such diluent can be selected from the group consisting of natural oils (e.g., mineral oils), synthetic oils and combinations thereof Some non-limiting examples of the mineral oils include paraffin-based oils, naphthenic-based oils, asphaltic-based oils and combinations thereof Some non-limiting examples of the synthetic base oils include polyolefin oils (especially hydrogenated alpha-olefin oligomers), alkylated aromatic, polyalkylene oxides, aromatic ethers, and carboxylate esters (especially diester oils) and combinations thereof In some embodiments, the diluent is a light hydrocarbon oil, both natural or synthetic. Generally, the diluent oil can have a viscosity from about 13 centistokes to about 35 centistokes at 40 ° C.

Oil of Lubricating Viscosity

The lubricant compositions of this invention include a major amount of base oil of lubricating viscosity. Base Oil as used herein is defined as a base stock or blend of base stocks which is a lubricant component that is produced by a single manufacturer to the same specifications (independent of feed source or manufacturer's location): that meets the same manufacturer's specification; and that is identified by a unique formula, product identification number, or both. Base stocks may be manufactured using a variety of different processes including but not limited to distillation, solvent refining, hydrogen processing, oligomerization, esterification, and rerefining. Rerefined stock shall be substantially free from materials introduced through manufacturing, contamination, or previous use. The base oil of this invention may be any natural or synthetic lubricating base oil fraction particularly those having a kinematic viscosity at 100 degrees Centigrade (C) and about 5 centistokes (cSt) to about 20 cSt, preferably about 7 cSt to about 16 cSt, more preferably about 9 cSt to about 15 cSt. Hydrocarbon synthetic oils may include, for example, oils prepared from the polymerization of ethylene, i.e., polyalphaolefin or PAO, or from hydrocarbon synthesis procedures using carbon monoxide and hydrogen gases such as in a Fisher-Tropsch process. A preferred base oil is one that comprises little, if any, heavy fraction; e.g., little, if any, lube oil fraction of viscosity 20 cSt or higher at 100 degrees C.

The base oil may be derived from natural lubricating oils, synthetic lubricating oils or mixtures thereof Suitable base oil includes base stocks obtained by isomerization of synthetic wax and slack wax, as well as hydrocrackate base stocks produced by hydrocracking (rather than solvent extracting) the aromatic and polar components of the crude. Suitable base oils include those in all API categories I, II, III, IV and V as defined in API Publication 1509, 14th Edition, Addendum I, December 1998. Saturates levels and viscosity indices for Group I, II and III base oils are listed in Table 1. Group IV base oils are polyalphaolefins (PAO). Group V base oils include all other base oils not included in Group I, II, III, or IV. Although Group II, III and IV base oils are preferred for use in this invention, these preferred base oils may be prepared by combining one or more of Group I, II, III, IV and V base stocks or base oils.

TABLE 1

Saturates, Sulfur and Viscosity Index of Group I, II and III Base Stocks

| Group | Saturates (As determined by ASTM D 2007) Sulfur (As determined by ASTM D 2270) | Viscosity Index (As determined by ASTM D 4294, ASTM D 4297 or ASTM D 3120) |
|---|---|---|
| I | Less than 90% saturates and/or Greater than to 0.03% sulfur | Greater than or equal to 80 and less than 120 |
| II | Greater than or equal to 90% saturates and less than or equal to 0.03% sulfur | Greater than or equal to 80 and less than 120 |
| III | Greater than or equal to 90% saturates and less than or equal to 0.03% sulfur | Greater than or equal to 120 |

Natural lubricating oils may include animal oils, vegetable oils (e.g., rapeseed oils, castor oils and lard oil), petroleum oils, mineral oils, and oils derived from coal or shale.

Synthetic oils may include hydrocarbon oils and halo-substituted hydrocarbon oils such as polymerized and interpolymerized olefins, alkylbenzenes, polyphenyls, alkylated diphenyl ethers, alkylated diphenyl sulfides, as well as their derivatives, analogues and homologues thereof, and the like. Synthetic lubricating oils also include alkylene oxide polymers, interpolymers, copolymers and derivatives thereof wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers. Tri-alkyl phosphate ester oils such as those exemplified by tri-n-butyl phosphate and tri-iso-butyl phosphate are also suitable for use as base oils.

Silicon-based oils (such as the polyakyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The base oil may be derived from unrefined, refined, rerefined oils, or mixtures thereof. Unrefined oils are obtained directly from a natural source or synthetic source (e.g., coal, shale, or tar sand bitumen) without further purification or treatment. Examples of unrefined oils include a shale oil obtained directly from a retorting operation, a petroleum oil obtained directly from distillation, or an ester oil obtained directly from an esterification process, each of which may then be used without further treatment. Refined oils are similar to the unrefined oils except that refined oils have been treated in one or more purification steps to improve one or more properties. Suitable purification techniques include distillation, hydrocracking, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and often are additionally processed by techniques for removal of spent additives and oil breakdown products.

Base oil derived from the hydroisomerization of wax may also be used, either alone or in combination with the aforesaid natural and/or synthetic base oil. Such wax isomerate oil is produced by the hydroisomerization of natural or synthetic waxes or mixtures thereof over a hydroisomerization catalyst.

It is preferred to use a major amount of base oil in the lubricating oil of this invention. A major amount of base oil as defined herein comprises greater than about 50 wt. % to about 97 wt. % of at least one of Group II, III and IV base oil or more preferably about 60 wt. % to about 97 wt. % of at least one of Group II, III and IV base oil. (When wt. % is used herein, it is referring to wt. % of the lubricating oil unless otherwise specified.) A more preferred embodiment of this invention may comprise an amount of base oil that comprises about 85 wt. % to about 95 wt. % of the lubricating oil.

Oil Soluble Molybdenum Compound

Oil soluble molybdenum compounds and molybdenum/sulfur complexes are known in the art and are described, for example, in U.S. Pat. No. 4,263,152 to King et al., and U.S. Pat. No. 6,962,896 to Ruhe, the disclosures of which is hereby incorporated by reference and which are particularly preferred. Other representative of the molybdenum compounds which can be used in this invention include: glycol molybdate complexes as described by Price et al. in U.S. Pat. No. 3,285,942; overbased alkali metal and alkaline earth metal sulfonates, phenates and salicylate compositions containing molybdenum such as those disclosed and claimed by Hunt et al in U.S. Pat. No. 4,832,857; molybdenum complexes prepared by reacting a fatty oil, a diethanolamine and a molybdenum source as described by Rowan et al in U.S. Pat. No. 4,889,647; a sulfur and phosphorus-free organomolybdenum complex of organic amide, such as molybdenum containing compounds prepared from fatty acids and 2-(2-aminoethyl) aminoethanol as described by Karol in U.S. Pat. No. 5,137,647 and molybdenum containing compounds prepared from 1-(2-hydroxyethyl)-2-imidazoline substituted by a fatty residue derived from fatty oil or a fatty acid; overbased molybdenum complexes prepared from amines, diamines, alkoxylated amines, glycols and polyols as described by Gallo et al in U.S. Pat. No. 5,143,633; 2,4-heteroatom substituted-molybdena-3,3-dioxacycloalkanes as described by Karol in U.S. Pat. No. 5,412,130; and mixtures thereof Representative molybdenum compounds of the above are commercially available and include but, are not limited to: Sakura-Lube® 700 supplied by the Asahi Denka Kogyo K.K. of Tokyo, Japan, a molybdenum amine complex; molybdenum HEX-CEM®. supplied by the OM Group, Inc., of Cleveland, Ohio, a molybdenum 2-ethylhexanoate; molybdenum octoate supplied by The Shepherd Chemical Company of Cincinnati, Ohio, a molybdenum 2-ethylhexanoate; Molyvan®855 supplied by the R.T. Vanderbilt Company, Inc., of Norwalk, Conn., a sulfur and phosphorus-free organomolybdenum complex of organic amide; Molyvan®856-B also from R.T. Vanderbilt, an organomolybdenum complex.

Particularly preferred oil soluble molybdenum complexes are unsulfurized or sulfurized oxymolybdenum containing compositions which can be prepared by (i) reacting an acidic molybdenum compound and a basic nitrogen compound selected from the dispersant group consisting of succinimide, a carboxylic acid amide, a hydrocarbyl monoamine, a phosphoramide, a thiophosphoramide, a Mannich base, a dispersant viscosity index improver, or a mixture thereof in the presence of a polar promoter, to form an oxymolybdenum complex. This oxymolybdenum complex can be reacted with a sulfur containing compound, to thereby form a sulfurized oxymolybdenum containing composition, useful within the context of this invention. Preferably the dispersant is a polyisobutenyl succinimide. The oxymolybdenum or sulfurized oxymolybdenum containing compositions may be generally characterized as a sulfur/molybdenum complex of a basic nitrogen dispersant compound preferably with a sulfur to molybdenum weight ratio of about (0.01 to 1.0) to 1 and more preferably from about (0.05 to 0.5) to 1 and a nitrogen to molybdenum weight ratio of about (1 to 10) to 1 and more preferably from (2 to 5) to 1. The precise molecular formula of these oxymolybdenum compositions are not known with certainty. However, they are believed to be compounds in which molybdenum, whose valences are satisfied with atoms of oxygen or sulfur, is either complexed by, or the salt of one or more nitrogen atoms of the basic nitrogen atoms of the basic nitrogen containing compound used in the preparation of these compositions. In one aspect, the oxymolybdenum complex is prepared at a reaction temperature at or below 120 degrees centigrade and if optionally sulfurized, it is also reacted at or below 120 degrees centigrade. Such a process yields a lighter color product when compared to higher temperature reaction conditions at equivalent pressure.

The molybdenum compounds used to prepare the oxymolybdenum and oxymolybdenum/sulfur complexes employed in this invention are acidic molybdenum compounds. By acidic is meant that the molybdenum compounds will react with a basic nitrogen compound as measured by ASTM test D-664 or D-2896 titration procedure. Typically these molybdenum compounds are hexavalent and are represented by the following compositions: molybdic acid, ammonium molybdate, sodium molybdate, potassium molybdate and other alkaline metal molybdates and other molybdenum salts such as hydrogen salts, e.g., hydrogen sodium molybdate, $MoOCl_4$, $MoO_2Br_2$, $Mo_2O_3Cl_6$, molybdenum trioxide, bis (acetylacetonato)-dioxomolybdenum (VI) or similar acidic molybdenum compounds. Preferred acidic molybdenum compounds are molybdic acid, ammonium molybdate, and alkali metal molybdates. Particularly preferred are molybdic acid and ammonium molybdate.

The basic nitrogen compound used to prepare the oxymolybdenum complexes have at least one basic nitrogen and are preferably oil-soluble. Typical examples of such compositions are succinimides, carboxylic acid amides, hydrocarbyl monoamines, hydrocarbon polyamines, Mannich bases, phosphoramides, thiophosphoramides, phosphonamides, dispersant viscosity index improvers, and mixtures thereof. Any of the nitrogen-containing compositions may be after-treated with, e.g., boron, using procedures well known in the art so long as the compositions continue to contain basic nitrogen. These after-treatments are particularly applicable to succinimides and Mannich base compositions.

The mono and polysuccinimides that can be used to prepare the molybdenum complexes described herein are disclosed in numerous references and are well known in the art. Certain fundamental types of succinimides and the related materials encompassed by the term of art "succinimide" are taught in U.S. Pat. Nos. 3,219,666; 3,172,892; and 3,272,746, the disclosures of which are hereby incorporated by reference. The term "succinimide" is understood in the art to include many of the amide, imide, and amidine species which may also be formed. The predominant product however is a succinimide and this term has been generally accepted as meaning the product of a reaction of an alkenyl substituted succinic acid or anhydride with a nitrogen-containing compound. Preferred succinimides, because of their commercial availability, are those succinimides prepared from a hydrocarbyl succinic anhydride, wherein the hydrocarbyl group contains from about 24 to about 350 carbon atoms, and an ethylene amine, said ethylene amines being especially characterized by ethylene diamine, diethylene triamine, triethylene tetramine, and tetraethylene pentamine. Particularly preferred are those succinimides prepared from polyisobutenyl succinic anhydride of 70 to 128 carbon atoms and tetraethylene pentamine or triethylene tetramine or mixtures thereof.

Also included within the term "succinimide" are the cooligomers of a hydrocarbyl succinic acid or anhydride and a poly secondary amine containing at least one tertiary amino nitrogen in addition to two or more secondary amino groups. Ordinarily this composition has between 1,500 and 50,000 average molecular weight. A typical compound would be that prepared by reacting polyisobutenyl succinic anhydride and ethylene dipiperazine.

Carboxylic acid amide compositions are also suitable starting materials for preparing the oxymolybdenum complexes employed in this invention. Typical of such compounds are those disclosed in U.S. Pat. No. 3,405,064, the disclosure of which is hereby incorporated by reference. These compositions are ordinarily prepared by reacting a carboxylic acid or anhydride or ester thereof, having at least 12 to about 350 aliphatic carbon atoms in the principal aliphatic chain and, if desired, having sufficient pendant aliphatic groups to render the molecule oil soluble with an amine or a hydrocarbyl polyamine, such as an ethylene amine, to give a mono or polycarboxylic acid amide. Preferred are those amides prepared from (1) a carboxylic acid of the formula R'COOH, where R' is $C_{12-20}$ alkyl or a mixture of this acid with a polyisobutenyl carboxylic acid in which the polyisobutenyl group contains from 72 to 128 carbon atoms and (2) an ethylene amine, especially triethylene tetramine or tetraethylene pentamine or mixtures thereof Another class of compounds which are useful in this invention are hydrocarbyl monoamines and hydrocarbyl polyamines, preferably of the type disclosed in U.S. Pat. No. 3,574,576, the disclosure of which is hereby incorporated by reference. The hydrocarbyl group, which is preferably alkyl, or olefinic having one or two sites of unsaturation, usually contains from 9 to 350, preferably from 20 to 200 carbon atoms. Particularly preferred hydrocarbyl polyamines are those which are derived, e.g., by reacting polyisobutenyl chloride and a polyalkylene polyamine, such as an ethylene amine, e.g., ethylene diamine, diethylene triamine, tetraethylene pentamine, 2-aminoethylpiperazine, 1,3-propylene diamine, 1,2-propylenediamine, and the like.

Another class of compounds useful for supplying basic nitrogen are the Mannich base compositions. These compositions are prepared from a phenol or $C_{9-200}$ alkylphenol, an aldehyde, such as formaldehyde or formaldehyde precursor such as paraformaldehyde, and an amine compound. The amine may be a mono or polyamine and typical compositions are prepared from an alkylamine, such as methylamine or an ethylene amine, such as, diethylene triamine, or tetraethylene pentamine, and the like. The phenolic material may be sulfurized and preferably is dodecylphenol or a $C_{80-100}$ alkylphenol. Typical Mannich bases which can be used in this invention are disclosed in U.S. Pat. Nos. 4,157,309 and 3,649,229; 3,368,972; and 3,539,663, the disclosures of which are hereby incorporated by reference. The last referenced patent discloses Mannich bases prepared by reacting an alkylphenol having at least 50 carbon atoms, preferably 50 to 200 carbon atoms with formaldehyde and an alkylene polyamine $HN(ANH)_nH$ where A is a saturated divalent alkyl hydrocarbon of 2 to 6 carbon atoms and n is 1-10 and where the condensation product of said alkylene polyamine may be further reacted with urea or thiourea. The utility of these Mannich bases as starting materials for preparing lubricating oil additives can often be significantly improved by treating the Mannich base using conventional techniques to introduce boron into the composition.

Another class of composition useful for preparing the oxymolybdenum complexes employed in this invention are the phosphoramides and phosphonamides such as those disclosed in U.S. Pat. Nos. 3,909,430 and 3,968,157, the disclosures of which are hereby incorporated by reference. These compositions may be prepared by forming a phosphorus compound having at least one P-N bond. They can be prepared, for example, by reacting phosphorus oxychloride with a hydrocarbyl diol in the presence of a monoamine or by reacting phosphorus oxychloride with a difunctional secondary amine and a mono-functional amine. Thiophosphoramides can be prepared by reacting an unsaturated hydrocarbon compound containing from 2 to 450 or more carbon atoms, such as polyethylene, polyisobutylene, polypropylene, ethylene, 1-hexene, 1,3-hexadiene, isobutylene, 4-methyl-1-pentene, and the like, with phosphorus pentasulfide and a nitrogen-containing compound as defined above, particularly an alkylamine, alkyldiamine, alkylpolyamine, or an alkyleneamine, such as ethylene diamine, diethylenetriamine, triethylenetetramine, tetraethylenepentamine, and the like.

Another class of nitrogen-containing compositions useful in preparing the molybdenum complexes employed in this invention includes the so-called dispersant viscosity index improvers (VI improvers). These VI improvers are commonly prepared by functionalizing a hydrocarbon polymer, especially a polymer derived from ethylene and/or propylene, optionally containing additional units derived from one or more co-monomers such as alicyclic or aliphatic olefins or diolefins. The functionalization may be carried out by a variety of processes which introduce a reactive site or sites which usually has at least one oxygen atom on the polymer. The polymer is then contacted with a nitrogen-containing source to introduce nitrogen-containing functional groups on the polymer backbone. Commonly used nitrogen sources include any basic nitrogen compound especially those nitrogen-containing compounds and compositions described herein. Preferred nitrogen sources are alkylene amines, such as ethylene amines, alkyl amines, and Mannich bases.

Preferred basic nitrogen compounds for use in this invention are succinimides, carboxylic acid amides, and Mannich bases. More preferred are succinimides having an average molecular weight of 1000 or 1300 or 2300 and mixtures thereof. Such succinimides can be post treated with boron or ethylene carbonate as known in the art.

The oxymolybdenum complexes of this invention can also be sulfurized. Representative sulfur sources for preparing the oxymolybdenum/sulfur complexes used in this invention are sulfur, hydrogen sulfide, sulfur monochloride, sulfur dichloride, phosphorus pentasulfide, $R''_2S_x$ where R" is hydrocarbyl, preferably $C_{1-40}$ alkyl, and x is at least 2, inorganic sulfides and polysulfides such as $(NH_4)_2S_y$, where y is at least 1, thioacetamide, thiourea, and mercaptans of the formula R"SH where R" is as defined above. Also useful as sulfurizing agents are traditional sulfur-containing antioxidants such as wax sulfides and polysulfides, sulfurized olefins, sulfurized carboxylic and esters and sulfurized ester-olefins, and sulfurized alkylphenols and the metal salts thereof.

The sulfurized fatty acid esters are prepared by reacting sulfur, sulfur monochloride, and/or sulfur dichloride with an unsaturated fatty ester under elevated temperatures. Typical esters include $C_1$-$C_{20}$ alkyl esters of $C_8$-$C_{24}$ unsaturated fatty acids, such as palmitoleic, oleic, ricinoleic, petroselinic, vaccenic, linoleic, linolenic, oleostearic, licanic, paranaric, tariric, gadoleic, arachidonic, cetoleic, etc. Particularly good results have been obtained with mixed unsaturated fatty acid esters, such as are obtained from animal fats and vegetable oils, such as tall oil, linseed oil, olive oil, caster oil, peanut oil, rape oil, fish oil, sperm oil, and so forth. Exemplary fatty esters include lauryl tallate, methyl oleate, ethyl oleate, lauryl oleate, cetyl oleate, cetyl linoleate, lauryl ricinoleate, oleyl linoleate, oleyl stearate, and alkyl glycerides.

Cross-sulfurized ester olefins, such as a sulfurized mixture of $C_{10}$-$C_{25}$ olefins with fatty acid esters of $C_{10}$-$C_{25}$ fatty acids and $C_{10}$-$C_{25}$ alkyl or alkenyl alcohols, wherein the fatty acid and/or the alcohol is unsaturated may also be used.

Sulfurized olefins are prepared by the reaction of the $C_3$-$C_6$ olefin or a low-molecular-weight polyolefin derived therefrom with a sulfur-containing compound such as sulfur, sulfur monochloride, and/or sulfur dichloride.

Also useful are the aromatic and alkyl sulfides, such as dibenzyl sulfide, dixylyl sulfide, dicetyl sulfide, diparaffin wax sulfide and polysulfide, cracked wax-olefin sulfides and so forth. They can be prepared by treating the starting material, e.g., olefinically unsaturated compounds, with sulfur, sulfur monochloride, and sulfur dichloride. Particularly preferred are the paraffin wax thiomers described in U.S. Pat. No. 2,346,156.

Sulfurized alkyl phenols and the metal salts thereof include compositions such as sulfurized dodecylphenol and the calcium salts thereof. The alkyl group ordinarily contains from 9-300 carbon atoms. The metal salt may be preferably, a Group I or Group II salt, especially sodium, calcium, magnesium, or barium.

Preferred sulfur sources are sulfur, hydrogen sulfide, phosphorus pentasulfide, $R'''_2S_z$ where R'''is hydrocarbyl, preferably $C_1$-$C_{10}$ alkyl, and z is at least 3, mercaptans wherein R'''is $C_1$-$C_{10}$ alkyl, inorganic sulfides and polysulfides, thioacetamide, and thiourea. Most preferred sulfur sources are sulfur, hydrogen sulfide, phosphorus pentasulfide, and inorganic sulfides and polysulfides.

The polar promoter used in the preparation of the molybdenum complexes employed in this invention is one which facilitates the interaction between the acidic molybdenum compound and the basic nitrogen compound. A wide variety of such promoters are well known to those skilled in the art. Typical promoters are 1,3-propanediol, 1,4-butane-diol, diethylene glycol, butyl cellosolve, propylene glycol, 1,4-butyleneglycol, methyl carbitol, ethanolamine, diethanolamine, N-methyl-diethanol-amine, dimethyl formamide, N-methyl acetamide, dimethyl acetamide, methanol, ethylene glycol, dimethyl sulfoxide, hexamethyl phosphoramide, tetrahydrofuran and water. Preferred are water and ethylene glycol. Particularly preferred is water. While ordinarily the polar promoter is separately added to the reaction mixture, it may also be present, particularly in the case of water, as a component of non-anhydrous starting materials or as waters of hydration in the acidic molybdenum compound, such as $(NH_4)_6Mo_7O_{24}.H_2O$. Water may also be added as ammonium hydroxide.

A method for preparing the oxymolybdenum complexes used in this invention is to prepare a solution of the acidic molybdenum precursor and a polar promoter with a basic nitrogen-containing compound with or without diluent. The diluent is used, if necessary, to provide a suitable viscosity for easy stirring. Typical diluents are lubricating oil and liquid compounds containing only carbon and hydrogen. If desired, ammonium hydroxide may also be added to the reaction mixture to provide a solution of ammonium molybdate. This reaction is carried out at a variety of temperatures, typically at or below the melting point of the mixture to reflux temperature. It is ordinarily carried out at atmospheric pressure although higher or lower pressures may be used if desired. This reaction mixture may optionally be treated with a sulfur source as defined above at a suitable pressure and temperature for the sulfur source to react with the acidic molybdenum and basic nitrogen compounds. In some cases, removal of water from the reaction mixture may be desirable prior to completion of reaction with the sulfur source. In a preferred and improved method for preparing the oxymolybdenum complexes, the reactor is agitated and heated at a temperature less than or equal to about 120 degrees Celsius, preferably from about 70 degrees Celsius to about 90 degrees Celsius. Molybdic oxide or other suitable molybdenum source is then charged to the reactor and the temperature is maintained at a temperature less than or equal to about 120 degrees Celsius, preferably at about 70 degrees Celsius to about 90 degrees Celsius, until the molybdenum is sufficiently reacted. Excess water is removed from the reaction mixture. Removal methods include but are not limited to vacuum distillation or nitrogen stripping while maintaining the temperature of the reactor at a temperature less than or equal to about 120 degrees Celsius, preferably between about 70 degrees Celsius to about 90 degrees Celsius. The temperature during the stripping process is held at a temperature less than or equal to about 120 degrees Celsius to maintain the low color intensity of the molybdenum-containing composition. It is ordinarily carried out at atmospheric pressure although higher or lower pressures may be used. The stripping step is typically carried out for a period of about 0.5 to about 5 hours.

If desired, this product can be sulfurized by treating this reaction mixture with a sulfur source as defined above at a suitable pressure and temperature, not to exceed about 120 degrees Celsius for the sulfur source to react with the acidic molybdenum and basic nitrogen compounds. The sulfurization step is typically carried out for a period of from about 0.5 to about 5 hours and preferably from about 0.5 to about 2 hours. In some cases, removal of the polar promoter (water) from the reaction mixture may be desirable prior to completion of reaction with the sulfur source.

In the reaction mixture, the ratio of molybdenum compound to basic nitrogen compound is not critical; however, as the amount of molybdenum with respect to basic nitrogen increases, the filtration of the product becomes more difficult. Since the molybdenum component probably oligomerizes, it is advantageous to add as much molybdenum as can easily be maintained in the composition. Usually, the reaction mixture will have charged to it from 0.01 to 2.00 atoms of molybdenum per basic nitrogen atom. Preferably from 0.3 to 1.0, and most preferably from 0.4 to 0.7, atoms of molybdenum per atom of basic nitrogen is added to the reaction mixture.

When optionally sulfurized, the sulfurized oxymolybdenum containing compositions may be generally characterized as a sulfur/molybdenum complex of a basic nitrogen dispersant compound preferably with a sulfur to molybdenum weight ratio of about (0.01 to 1.0) to 1 and more preferably from about (0.05 to 0.5) to 1 and a nitrogen to molybdenum weight ratio of about (1 to 10) to 1 and more preferably from (2 to 5) to 1. For extremely low sulfur incorporation the sulfur to molybdenum weight ratio can be from (0.01 to 0.08) to 1.

The sulfurized and unsulfurized oxymolybdenum complexes of this invention are typically employed in a lubricating oil in an amount of 0.01 to 10 %, more preferably from 0.04 to 1 wt %.

Additional components may be added to the synergist combination of component a) and component b) to further the resistance to oxidation of the organic substrate and which may add to the synergism. Particularly preferred is a component which operates as a peroxy radical scavenger. These hydroperoxide decomposers convert hydroperoxides into non-radical products thus preventing chain propagation reactions. Commonly organosulfur and organophophorous compounds have severed this purpose, and many suitable compounds have identified herein above with regard the oxymolybdenum component and need not be repeated again. Particularly preferred organophosphorous compounds are the oil-soluble, phosphorus-containing, anti-wear compounds selected from the group consisting of metal dithiophosphates, phosphorus esters (including phosphates, phosphonates, phosphinates, phosphine oxides, phosphites, phosphonites, phosphinites, phosphines and the like), amine phosphates and amine phosphinates, sulfur-containing phosphorus esters including phosphoro monothionate and phosphoro dithionates, phosphoramides, phosphonamides and the like. More preferably, the phosphorus-containing compound is a metal dithiophosphate and, even more preferably, a zinc dithiophosphate. Suitable phosphorous compounds are disclosed in U.S. Pat. No. 6,696,393, incorporated herein by reference.

The following additive components are examples of components that can be favorably employed in combination with the lubricating additive of the present invention. These examples of additives are provided to illustrate the present invention, but they are not intended to limit it.

(A) Ashless dispersants: alkenyl succinimides, alkenyl succinimides modified with other organic compounds such as ethylene carbonate, polysuccinimides, and alkenyl succinimides modified with boric acid, alkenyl succinic ester.

(B) Oxidation inhibitors:

1) Phenol type phenolic) oxidation inhibitors: 4,4'-methylenebis (2,6-di-tert-butylphenol),4,4'-bis(2,6-di-tert-butylphenol), 4,4'-bis(2-methyl-6-tert-butylphenol), 2,2'-(methylenebis(4-methyl-6-tert-butyl-phenol), 4,4'-butylidenebis (3-methyl-6-tert-butylphenol), 4,4'-isopropylidenebis(2,6-di-tert-butylphenol), 2,2'-methylenebis(4-methyl-6-nonylphenol), 2,2'-isobutylidene-bis(4,6-dimethylphenol), 2,2'-methylenebis(4-methyl-6-cyclohexylphenol), 2,6-di-tert-butyl4-methylphenol, 2,6-di-tert-butyl4-ethylphenol, 2,4-dimethyl-6-tert-butyl-phenol, 2,6-di-tert-α-dimethylamino-p-cresol, 2,6-di-tert-4 (N.N'dimethylaminomethylphenol),4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis (3,5-di-tert-butyl4-hydroxybenzyl).

2) Diphenylamine type oxidation inhibitor: alkylated diphenylamine, phenyl-α-naphthylamine, and alkylated α-naphthylamine.

3) Other types: metal dithiocarbamate (e.g., zinc dithiocarbamate), and methylenebis (dibutyldithiocarbamate).

(C) Rust inhibitors (Anti-rust agents):

1) Nonionic polyoxyethylene surface active agents: polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol mono-oleate, and polyethylene glycol monooleate.

2) Other compounds: stearic acid and other fatty acids, dicarboxylic acids, metal soaps, fatty acid amine salts, metal salts of heavy sulfonic acid, partial carboxylic acid ester of polyhydric alcohol, and phosphoric ester.

(D) Demulsifiers: addition product of alkylphenol and ethyleneoxide, polyoxyethylene alkyl ether, and polyoxyethylene sorbitane ester.

(E) Extreme pressure agents (EP agents):, sulfurized oils, diphenyl sulfide, methyl trichlorostearate, chlorinated naphthalene, benzyl iodide, fluoroalkylpolysiloxane, and lead naphthenate.

(F) Friction modifiers: fatty alcohol, fatty acid, amine, borated ester, and other esters (G) Multifunctional additives: sulfurized oxymolybdenum dithiocarbamate, sulfurized oxymolybdenum organo phosphorodithioate, oxymolybdenum monoglyceride, oxymolybdenum diethylate amide, amine-molybdenum complex compound, and sulfur-containing molybdenum complex compound (H) Viscosity Index improvers: polymethacrylate type polymers, ethylene-propylene copolymers, styrene-isoprene copolymers, hydrated styrene-isoprene copolymers, polyisobutylene, and dispersant type viscosity index improvers.

(I) Pour point depressants: polymethyl methacrylate.

(K) Foam Inhibitors: alkyl methacrylate polymers and dimethyl silicone polymers.

(L) Wear inhibitors: zinc dialkyldithiophosphate (Zn-DTP, primary alkyl type & secondary alkyl type).

EXAMPLES

The invention is further illustrated by the following examples, which are not to be considered as limitative of its scope. A further understanding of the invention can be had in the following nonlimiting Preparations and Examples. Wherein unless expressly stated in the contrary, all temperatures and temperatures ranges refer to the Centigrade system and the term "ambient" or "room temperature" refers to about 20 to 25° C. The term "percent or %" refers to weight percent, and the term "mole" or "moles" refers to gram moles. The term "equivalent" refers to a quantity of reagent equal in moles, to the moles of the preceding or succeeding reactant recited in that example in terms of finite moles or finite weight or volume.

The lubricating oil compositions disclosed herein can be prepared by any method known to a person of ordinary skill in the art for making lubricating oils. In some embodiments, the base oil can be blended or mixed with N,N,N',N'-tetraalkyl-naphthalene-1,8-diamine compound neat or in combination with the other additive component(s). The N,N,N',N'-tetraalkyl-naphthalene-1,8-diamine compound and the optional additives may be added to the base oil individually or simultaneously and the one or more additions may be in any order. In some embodiments, the solubilizing of the N,N,N',N'-tetraalkyl-naphthalene-1,8-diamine compound or any solid additives in the base oil may be assisted by heating the mixture to a temperature from about 25° C. to about 200 ° C., from about 50 ° C. to about 150 ° C. or from about 75° C. to about 125 ° C.

Any mixing or dispersing equipment known to a person of ordinary skill in the art may be used for blending, mixing or solubilizing the ingredients. The blending, mixing or solubilizing may be carried out with a blender, an agitator, a disperser, a mixer (e.g., planetary mixers and double planetary mixers), a homogenizer (e.g., Gaulin homogenizers and Rannie homogenizers), a mill (e.g., colloid mill, ball mill and sand mill) or any other mixing or dispersing equipment known in the art.

Performance Examples

Oxidation studies of the products of selected Examples were carried out in a bulk oil oxidation bench test as described by E. S. Yamaguchi et al. in Tribology Transactions, Vol. 42(4), 895-901 (1999). In this test the rate of oxygen uptake at constant pressure by a given weight of oil was monitored. The time required (induction time) for rapid oxygen uptake per 25 grams of sample was measured at 171° C. under 1.0 atmosphere of oxygen pressure. The sample was stirred at 1000 revolutions per minute. The results are reported, however, as time for rapid oxygen uptake per 100 grams of sample. The oil contained a catalyst added as oil soluble naphthenates to provide 26 ppm iron, 45 ppm copper, 512 ppm lead, 2.3 ppm manganese, and 24 ppm tin.

Performance Examples 1-13

A base line formulation was prepared which to assess the performance of the mixture of: component A) N,N,N',N'-tetramethyl-naphthalene-1,8-diamine and sold by Sigma-Aldrich as Proton-sponge™, and component B1) a commercially available alkylated diphenylamine (mixture t-butyl and t-octyl—prepared by alkylating diphenylamine with 2,4,4-trimethylpentene) and sold by Ciba-Geigy as Irganox® L-57 or B2) a commercially available bis(nonylphenylamine)amine and sold by Chemtura as Naugalube® 438L; in the oxidator bench test. The base line formulation—Formulation A, contained in a Group 2+ base oil, 12.5 mmoles/kg dialkyl zinc dithiophosphate, 5.0% polyisobutenyl succinimide, 35.0 mmoles/kg overbased calcium sulfonate detergent, 15.0 mmole/kg calcium phenate detergent and 0.3% V.I. improver. The Formulation A baseline was tested in the bulk oil oxidation bench test above and resulted in a value of 7.0 hours to rapid $O_2$ uptake. To this baseline (Formulation A) were varying amounts of component A with varying amounts of added component B1) or B2). The results are depicted in Table 1 and Table 2 below:

TABLE 1

| | Synergistic Mixture Top Treated to Formulation A | | |
|---|---|---|---|
| Performance Example | Component A) N,N,N',N'-tetramethyl-naphthalene-1,8-diamine concentration (weight percent) | Component B1) Alkylated diphenylamine[1] concentration (weight percent) | Results Hr to rapid $O_2$ uptake |
| | 0 | 0 | 7.0 |
| 1 | 0 | 0.5 | 15.0 |
| 2 | 0.5 | 0 | 15.0 |
| 3 | 0.5 | 0.5 | 42.0 |
| 4 | 1.0 | 0.5 | 66.0 |

[1]Irganox ® L57 is available commercially from Ciba-Geigy

TABLE 2

| Performance Example | Synergistic Mixture Top Treated to Formulation A: Component A) N,N,N',N'-tetramethyl-naphthalene-1,8-diamine concentration (weight percent) | Component B2) Alkylated diphenylamine[1] concentration (weight percent) | Results Hr to rapid $O_2$ uptake |
|---|---|---|---|
| | 0 | 0 | 7.0 |
| 5 | 0 | 0.5 | 12.0 |
| 6 | 0.5 | 0 | 15.0 |
| 7 | 0.25 | 0.5 | 16.0 |
| 8 | 0.5 | 0.5 | 19.0 |
| 9 | 0.75 | 0.5 | 33.0 |
| 10 | 1.0 | 0.5 | 43.0 |
| 11 | 1.25 | 0.5 | 49.0 |
| 12 | 1.5 | 0.5 | 67.0 |
| 13 | 2.0 | 0.5 | 116.0 |

[1]Naugalube ® 438L is available commercially from Chemtura

The excellent oxidation performance of N,N,N',N'-tetramethyl-naphthalene-1,8-diamine is shown in Example 2. The excellent oxidation performance of N,N,N',N'-tetramethyl-naphthalene-1,8-diamine in combination with diphenylamines is shown Examples 3,4 and 7-13.

What is claimed is:

1. A lubricating oil composition comprising at least one oil of lubricating viscosity and an oil soluble antioxidant herein the antioxidant is a mixture comprising:

a) from 0.1 to 10 weight percent of a first antioxidant according to formula I:

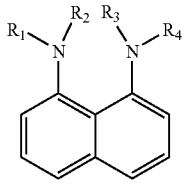

wherein $R_1$, $R_2$, $R_3$ and $R_4$ are each independently selected from alkyl groups each having from 1 to 20 carbon atoms; and b) from 0.01 to 10 weight percent of a second antioxidant selected from the formula

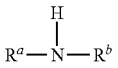

wherein $R^a$ and $R^b$ are each independently aryl from 6 to 10 carbon atoms which may be unsubstituted or substituted with one or two alkyl groups each having from 1 to 20 carbon atoms.

2. The lubricating oil composition according to claim 1, wherein the ratio of component a) to component b) is from about 0.75:1 to about 5:1.

3. The lubricating oil composition according to claim 1, wherein the total weight percent of the mixture of antioxidants in the composition is less than 5 weight percent.

4. The lubricating oil composition according to claim 1, wherein $R_1$, $R_2$, $R_3$ and $R_4$ are each independently selected from alkyl groups each having from 1 to 10 carbon atoms.

5. The lubricating oil composition according to claim 1, wherein component b) is selected from the group consisting of diphenylamine, monoalkylated diphenylamine, dialkylated diphenylamine, trialkylated diphenylamine, and mixtures thereof.

6. The lubricating oil composition according to claim 5, wherein component b) is selected from the group consisting of butyldiphenylamine, di-butyldiphenylamine, octyldiphenylamine, di-octyldiphenylamine, nonyldiphenylamine, di-nonyldiphenylamine, t-butyl-t-octyldiphenylamine, and mixtures thereof.

7. The lubricating oil composition according to claim 1, wherein component b) is selected from the group consisting of phenyl-alpha-naphthylamine, phenyl-beta-naphthylamine, t-octylated N-phenyl-1-naphthylamine.

8. The lubricating oil composition according to claim 1, further comprising an oil soluble molybdenum compound.

9. The lubricating oil composition according to claim 8, wherein the oil soluble molybdenum compound is an unsulfurized or sulfurized oxymolybdenum containing composition prepared by (i) reacting an acidic molybdenum compound and a basic nitrogen compound selected from the dispersant group consisting of succinimide, a carboxylic acid amide, a hydrocarbyl monoamine, a phosphoramide, a thiophosphoramide, a Mannich base, a dispersant viscosity index improver, or a mixture thereof in the presence of a polar promoter, to form an oxymolybdenum complex.

10. The composition according to claim 9, wherein the basic nitrogen compound is a succinimide.

11. The composition according to claim 1, further comprising an oil-soluble, phosphorus-containing, anti-wear compound selected from the group consisting of metal dithiophosphates, phosphorus esters, amine phosphates and amine phosphinates, sulfur-containing phosphorus esters, phosphoramides and phosphonamides.

12. The composition according to claim 11, wherein said phosphorus esters are selected from the group consisting of phosphates, phosphonates, phosphinates, phosphine oxides, phosphites, phosphonites, phosphinites, and phosphines.

13. The composition according to claim 11, wherein the oil-soluble, phosphorus-containing, anti-wear compound is a zinc dialkyldithiophosphate.

14. A method for lubricating an internal combustion engine comprising supplying thereto the lubricant composition of claim 1.

15. A lubricating oil composition comprising at least one oil of lubricating viscosity and an oil soluble antioxidant wherein the antioxidant is a mixture comprising:

a) from 0.1 to 2 weight percent of a first antioxidant according to formula I:

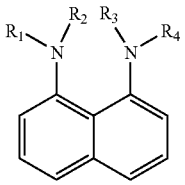

wherein $R_1$, $R_2$, $R_3$ and $R_4$ are each independently selected from alkyl groups each having from 1 to 20 carbon atoms; and b) from 0.1 to 2 weight percent of a second antioxidant selected from the formula

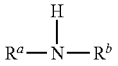
wherein $R^a$ and $R^b$ are each independently aryl from 6 to 10 carbon atoms which may be unsubstituted or substituted with one or two alkyl groups each having from 1 to 20 carbon atoms.
* * * * *